United States Patent [19]

Kinoshita

[11] Patent Number: 4,979,896

[45] Date of Patent: Dec. 25, 1990

[54] COOLING DEVICE OF HEATING FURNACE IN THERMAL ANALYZER

[75] Inventor: Ryoichi Kinoshita, Tokyo, Japan

[73] Assignee: Seiko Instruments, Inc., Tokyo, Japan

[21] Appl. No.: 426,292

[22] Filed: Oct. 25, 1989

[30] Foreign Application Priority Data

Oct. 26, 1988 [JP] Japan ..... 63-270344

[51] Int. Cl.[5] ..... F27D 1/12

[52] U.S. Cl. ..... 432/238; 432/77; 373/74; 373/76; 110/336

[58] Field of Search ..... 432/233, 238, 77, 83; 110/336; 373/74, 76

[56] References Cited

U.S. PATENT DOCUMENTS

| | | | |
|---|---|---|---|
| 1,751,008 | 3/1930 | France | 432/238 |
| 3,612,501 | 10/1971 | Berczynski | 432/238 |
| 4,119,792 | 10/1978 | Elsner et al. | 373/76 |
| 4,221,922 | 9/1980 | Okimune | 110/336 |
| 4,235,173 | 11/1980 | Sharp | 110/336 |
| 4,259,539 | 3/1981 | Elsner et al. | 373/76 |
| 4,398,701 | 8/1983 | Cordier et al. | 432/238 |
| 4,637,034 | 1/1987 | Grageda | 373/76 |

FOREIGN PATENT DOCUMENTS

| | | | |
|---|---|---|---|
| 3427407 | 1/1986 | Fed. Rep. of Germany | 432/238 |
| 1506976 | 11/1967 | France | 432/238 |

*Primary Examiner*—Henry C. Yuen

*Attorney, Agent, or Firm*—Spensley Horn Jubas & Lubitz

[57] ABSTRACT

A cooling device provided in a thermal analyzer to cool a heating furnace by heat exchange between a cooling medium and the heating furnace based on direct and uniform gas-to-solid contact, and constructed to facilitate replacement of a sample in the cooled furnace. The cooling device includes a jacket surrounding the heating furnace to define a closed annular space, an inlet formed to introduce cooling medium into the closed space, and an outlet formed to discharge the introduced cooling medium from the closed space. Cooling of the furnace is carried out due to the heat exchange between the cooling medium and the heating surface in the closed space. A top portion of the heating furnace is not covered by the jacket, but is exposed to thereby facilitate the replacement of a sample through the exposed top portion of the heating furnace.

9 Claims, 1 Drawing Sheet

COOLING DEVICE OF HEATING FURNACE IN THERMAL ANALYZER

BACKGROUND OF THE INVENTION

The present invention relates to a cooling device of a heating furnace provided in a thermal analyzer.

A conventional cooling device has a structure, for example, as shown in FIG. 5 and disclosed in Japanese Utility Model registration Application, Laid Open No. 22549/1987. As seen from FIG. 5, this conventional cooling device is constructed such that the entire portion of a heating furnace 59, including a sample replacement opening on a top portion of the furnace, is covered with a Dewar Vessel 57.

For measurements in this type of thermal analyzer, in order to impart to a sample a particular thermal hysteresis or thermal shock (for example, rapid cooling), the sample may be set in the heating furnace held at a particular temperature in a range below room temperature. In such case, according to the conventional structure, since the Dewar Vessel 57 entirely encloses the heating furnace 59, the Dewar Vessel must be removed in order to set a sample in the heating furnace. However, when removing the Dewar Vessel 57 in the prior art structure, atmospheric temperature around the heating furnace 59 rises to room temperature, thereby making it difficult to hold the heating furnace at the particular desired temperature below the room temperature. Consequently, measurements of the above-mentioned mode cannot be actually carried out, this representing a serious drawback in the conventional structure.

Recently, analyzers of the above kind are desirably provided with a robot mechanism, such as an auto-sampler, operable to effect automatic replacement and setting of a sample. In a thermal analyzer provided with a robot mechanism, such as an auto-sampler or automanipulator, the robot mechanism has to be operated to remove and return the Dewar Vessel 57 during the replacement and setting of a sample in the conventional structure. However, while a sample which is an object of the replacement and setting operation has normally a weight of less than 1 g, the Dewar Vessel of this type has a far heavier weight normally in the range from 500 g to 1000 g. Accordingly, the robot mechanism is normally constructed and set to handle the small weight of the sample which is the object of the replacement and setting, so that the identical robot mechanism cannot properly effect removal and return of the Dewar Vessel due to the considerable weight difference. Therefore, when providing a robot mechanism functioning as an auto-sampler, an additional robot mechanism is also needed to remove and return the Dewar Vessel 57, in addition to the robot mechanism used for replacement and setting of the sample.

As noted above, in the prior art, since the entirety of the heating furnace is surrounded by the Dewar Vessel, there have been various problems such as the difficulty of sample replacement while controlling the furnace below room temperature, and the necessity of an additional mechanism for removing the Dewar Vessel in addition to the main robot mechanism which is especially designed to handle the sample which is the object of the replacement and setting, and therefore, difficulties in replacing the sample.

The present invention is directed to an improved cooling device of the thermal analyzer, effective to facilitate the sample replacement and to carry out cooling as efficiently as the prior art structure while not utilizing a Dewar Vessel which would have to be displaced during the sample replacement.

SUMMARY OF THE INVENTION

Accordingly, an object of the present invention is to facilitate the replacement of a sample.

A cooling device for cooling a heating furnace provided in a thermal analyzer, the furnace having an exterior periphery and a top portion via which a sample is introduced into the heating furnace, said cooling device comprising:

means defining a jacket disposed so as to surround entirely the exterior periphery of the heating furnace to define a closed space between said jacket and the exterior periphery while leaving exposed the top portion of the heating furnace;

inlet means formed through said jacket and effective to introduce cooling medium into the closed space; and outlet means formed through said jacket and effective to discharge the cooling medium from the closed space.

By such construction, the cooling medium is charged into the closed space covered by the jacket through the introducing inlet opening to cool the heating furnace, and then is discharged through the separate outlet opening. Since the top portion of the heating furnace is not covered, but exposed, the replacement of a sample can be carried out through the exposed top portion of the heating furnace independently of the flow of the cooling medium to thereby facilitate the sample replacement.

DESCRIPTION OF THE PREFERRED EMBODIMENTS

Figure 1:
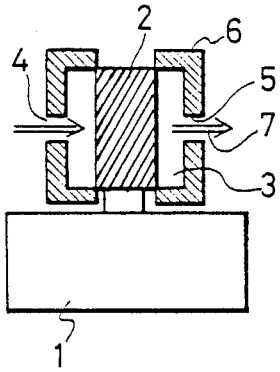
FIG. 1 is a simplified elevational cross-sectional view showing a first embodiment of the present invention.

FIGS. 1–4 illustrate a thermal analyzer 1 provided with a heating furnace 2. The outer periphery of furnace 2 is substantially entirely surrounded by a jacket which defines with that periphery an annular closed space 3. The jacket includes an inlet opening 4 for introducing cooling medium into the closed space 3 and an outlet opening 5 for discharging the introduced cooling medium from the closed space 3. The jacket includes thermally insulating material 6 is disposed around the closed space 3 to prevent dew condensation due to the cooling medium. Arrows 7 indicate flow of cooling medium around heating furnace 2.

Figure 2:
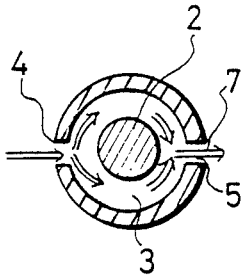
FIG. 2 is a top plan, cross-sectional view of the FIG. 1 embodiment to illustrate flow of cooling medium.

The cooling medium may be composed of a gas or liquid effective to cool the heating furnace 2 and can pass through the closed space 3 during use. As shown in FIG. 2, by means of an appropriate coolant supply (not shown), the cooling medium is introduced via inlet opening 4, then is circulated around heating furnace 2 to cool the same by heat exchange, and thereafter is discharged via outlet opening 5.

The jacket which borders the closed space 3 may include a one piece metal cover formed integrally with heating furnace 2 or a separate metal cover which is joined thermally to heating furnace 2 by fixing means such as screws. The jacket has a give shape to define the closed space 3 around the outer periphery of furnace 2. Consequently, when passing the cooling medium in the form of cooling gas through the closed space 3, heat exchange is effected in gas-to-solid contact around the heating furnace to thereby carry out the cooling of the furnace as efficiently as in the conventional structure.

More importantly, in embodiments according to the present invention, the closed space has an annular form to pass and circulate the cooling medium and is disposed to surround furnace 2, while a top portion of the heating furnace is exposed to thereby facilitate replacement of a sample through an entrance provided in the exposed top portion without disturbing or interrupting the flow of the cooling medium. Accordingly, by controlling the temperature of the heating furnace by a temperature control means (not shown in the figures) while producing a flow of an appropriate cooling medium; a sample can be set in the heating furnace 2 while the furnace is held at a particular temperature below room temperature.

In addition, a signal robot mechanism such as an auto-sampler can be added to automatically effect the replacement of a sample, and there is needed no other separate robot mechanism which would be needed in the conventional structure to remove a Dewar Vessel having a weight considerably greater than that of a sample object.

Figure 3:
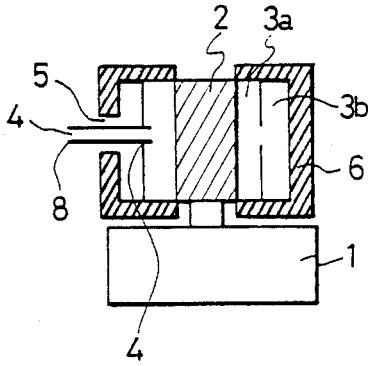
FIG. 3 is a view similar to that of FIG. 1 showing a second embodiment of the present invention.
Figure 4:
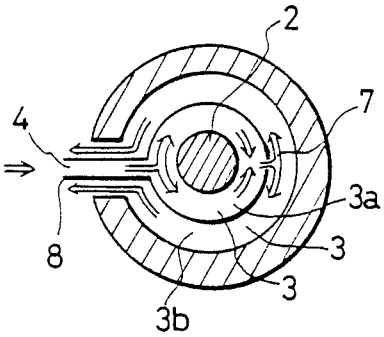
FIG. 4 is a top plan, cross-sectional view of the FIG. 3 embodiment to illustrate flow of cooling medium.
Figure 5:
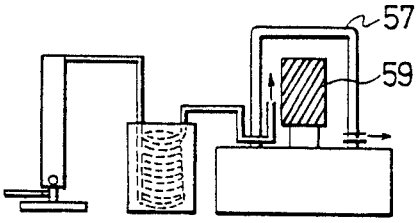
FIG.5 PRIOR ART
FIG. 5 is an elevational schematic view of a conventional cooling device.

Next, FIG. 3 shows a second embodiment having improved cooling efficiency compared to the FIG. 1 embodiment, and FIG. 4 is a top sectional view of the FIG. 3 embodiment to illustrate the flow of cooling medium.

In the FIG. 3 embodiment, the closed space of the annular shape surrounding heating furnace 2 has a double layer structure composed of an inner space 3*a* and an outer space 3*b*. The cooling medium is introduced via a cooling medium introduction pipe 8 through cooling medium inlet opening 4 which communicates with the inner space 3*a* of the double layer structure. As shown in FIG. 4, the introduced cooling medium flows around the heating furnace 2 to cool the same, and thereafter passes to the outer space 3*b*, flows around that space, and then is discharged via a cooling medium discharge outlet opening 5 which is formed to the same side as inlet opening 4 and surrounding pipe 8.

In this second embodiment, the cooling medium flow path is longer than that of the first embodiment in the closed space 3 around the heating furnace. Moreover, the inner space 3*a* which guides the cooling medium effective to directly cool the heating furnace 2 is surrounded by the outer space 3*b* which also guides the cooling medium so that the thermal insulating effect can be increased as compared to the FIG. 1 embodiment to thereby improve cooling capacity. The top portion of heating furnace 2 is also exposed in the second embodiment in similar manner to the first embodiment to thereby facilitate replacement of a sample.

As described above, according to the present invention, the cooling device of the thermal analyzer is provided with a closed space of annular shape which surrounds the entire outer periphery of the heating furnace, an inlet opening for introducing cooling medium into the closed space, and an outlet opening for discharging the cooling medium so as to pass the cooling medium through the closed space to cool the heating furnace by direct heat exchange between the heating furnace and the cooling medium. By such construction, the heat exchange efficiency is comparable to the prior art structure between the cooling medium and the heating furnace. Moreover, the closed space form through which the cooling medium has an annular form such that the top portion of the heating furnace is accessible to facilitate the replacement or introduction of a sample. In addition, since the cooling medium pass is shaped in the annular form and the cooling medium passage is not present on the top portion of the heating furnace, the cooling medium will not flow into the heating furnace through a sample admission opening formed on the top portion of the furnace so that the inventive cooling device can utilize liquid cooling medium which could not be used in the conventional cooling structure.

What is claimed is:

1. A cooling device for cooling a heating furnace provided in a thermal analyzer, the furnace having an exterior periphery and a top portion via which a sample is introduced into the heating furnace, said cooling device comprising:

means defining a jacket disposed so as to surround entirely the exterior periphery of the heating furnace to define a closed space between said jacket and the exterior periphery while leaving exposed the top portion of the heating furnace;

inlet means formed through said jacket and effective to introduce cooling medium into the closed space; and outlet means formed through said jacket and effective to discharge the cooling medium from the closed space.

2. A cooling device as defined in claim 1 wherein said jacket comprises a wall of thermally insulating material.

3. A cooling device as defined in claim 2 wherein said inlet means are diametrically opposite said outlet means.

4. A cooling device as defined in claim 2 further comprising a partition means disposed in said jacket and dividing the closed space into an inner annular space and an outer annular space enclosing said inner space.

5. A cooling device as defined in claim 4 wherein said inlet means communicate directly with said inner space and said outlet means communicate with said outer space 6. A cooling device as defined in claim 5 wherein said partition means have an opening defining a cooling medium flow passage between said inner and outer spaces.

7. A cooling device as defined in claim 6 wherein said opening is diametrically opposite said inlet means.

8. A cooling device as defined in claim 7 wherein said inlet means are located in the vicinity of said outlet means.

9. A cooling device as defined in claim 8 wherein said outlet mean surround said inlet means.

* * * * *